US008177223B2

(12) United States Patent
Bauer et al.

(10) Patent No.: US 8,177,223 B2
(45) Date of Patent: May 15, 2012

(54) SHEET FEEDER HAVING LIFTING UNIT

(75) Inventors: Eckhard Bauer, Kiel (DE); Soenke C. Bluethgen, Ploen (DE); Dimitrios Kostudis, Wedel (DE); Jorg Leyser, Kiel (DE); Ingo Neuber, Bornstein (DE); Stefan Schluenss, Schacht-Audorf (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/919,505

(22) PCT Filed: Apr. 10, 2008

(86) PCT No.: PCT/EP2008/054358

§ 371 (c)(1),
(2), (4) Date: Jan. 19, 2011

(87) PCT Pub. No.: WO2009/106148

PCT Pub. Date: Sep. 3, 2009

(65) Prior Publication Data

US 2011/0101603 A1 May 5, 2011

(30) Foreign Application Priority Data

Feb. 28, 2008 (DE) ..... 10 2008 011 513

(51) Int. Cl.
*B65H 1/26* (2006.01)

(52) U.S. Cl. ..... 271/157; 271/160; 271/145; 271/147

(58) Field of Classification Search ..... 271/145, 271/148, 147, 157, 160
See application file for complete search history.

(56) References Cited

U.S. PATENT DOCUMENTS

| | | | | |
|---|---|---|---|---|
| 5,364,087 | A | 11/1994 | Schieck et al. | |
| 5,634,188 | A * | 5/1997 | Johnston et al. | 399/393 |
| 5,961,113 | A * | 10/1999 | Morris | 271/22 |
| 6,039,315 | A * | 3/2000 | Lim | 271/160 |
| 6,123,329 | A * | 9/2000 | Sato et al. | 271/9.01 |
| 6,283,469 | B1 | 9/2001 | Weber | |
| 2006/0284366 | A1 | 12/2006 | Van Dongen et al. | |
| 2007/0120318 | A1 | 5/2007 | Moore | |
| 2011/0268552 | A1 * | 11/2011 | Brewer, III | 414/800 |

* cited by examiner

*Primary Examiner* — Kaitlin Joerger

(57) ABSTRACT

A lifting unit and a process for lifting a stack of sheets having at least a first support (20, 120, 220) and at least a second support (22, 122, 222) are described. The first support defines a first con-toured or flat support surface, and the second support defines a second support surface which has a substantially horizontal, flat main surface. In the lifting unit at least one unit is provided for lifting the first and second supports. During operation the supports are lifted such that at least a highest point of the first support is kept elevationally above the second support, the second support is lifted more quickly than the first support, and the substantially horizontal, flat main surface of the second support is kept in its horizontal alignment. The lifting unit is described, in combination with a sheet feeder.

50 Claims, 8 Drawing Sheets

SHEET FEEDER HAVING LIFTING UNIT

TECHNICAL FIELD

The present invention relates to a sheet feeder for feeding sheets from a stack of sheets to a downstream apparatus, such as a printing machine. In particular, the invention relates to a lifting unit for this type of sheet feeder.

BACKGROUND ART

In the printing technology it is known to separate out sheets from a stack of sheets individually and to feed them to a printing machine. For this purpose a wide variety of configurations of sheet feeders are known which generally feed sheets of even thickness. One such configuration has a lifting apparatus having a substantially flat support for accommodating a stack of sheets and a feed device disposed thereover. By means of the lifting apparatus the sheets of the stack of sheets are lifted into the region of the feed device and then received and conveyed away by the latter.

In some applications, however, the sheets to be fed are of different thicknesses in their end regions lying laterally to the feed direction. These sheets can for example carry a substrate to be printed. It is also possible for the sheet to have a punched out region which is held in position e.g. by means of adhesive tape, the sheet then having a different thickness in the region of the adhesive tape in comparison to the rest of the sheet. If this type of sheet having different thicknesses in the end regions is to be fed, the conventional sheet feeders can not be used because the upper side of the stack of sheets would be inclined if it were to lie on a horizontal support. Therefore, in the past special sheet feeders were developed for such applications. For example, U.S. patent application Ser. No. 2006/0284366 A1 shows a curved sheet support which is capable of accommodating a stack of sheets comprising sheets of different thicknesses in their end regions such that the uppermost sheet lies flat. By means of the support's special pivoting technology it is possible for the thicker end region of the stack of sheets to be lifted more quickly than the thinner end region so that the respective uppermost substrate remains flat and horizontal.

U.S. Pat. No. 6,283,469 B1 shows a sheet feeder which has a fixed horizontal support component and a second support component, which is pivotable in relation to the first support component. The pivotable component can be pivoted below the plane of the horizontal component in order to accommodate the region of the sheets having a greater thickness. By pivoting the pivotable component in relation to the horizontal component it is possible during the sheet feeding process to lift the thicker region of the stack of sheets more quickly than the component which remains horizontal so as to provide a substantially flat and horizontal alignment of the respective uppermost sheet of the stack of sheets.

DISCLOSURE OF INVENTION

In view of the prior art, it is an object of the present invention to provide an alternative lifting unit for a sheet feeder and a process for lifting a stack of sheets for sheets having different thicknesses in their end regions.

According to the invention this object is achieved by means of a lifting unit according to Claim 1, a sheet feeder according to Claim 25, a process for lifting a stack of sheets according to Claim 30 and a process for feeding a sheet to a downstream unit according to Claim 47. Further embodiments are claimed in the respective sub-claims.

According to one aspect, a lifting unit having at least a first support and at least a second support for lifting a stack of sheets is provided, the first support defining a first contoured or flat support surface, and the second support defining a second support surface which has a substantially horizontal, flat main surface. At least one unit is provided for lifting the first and second supports such that at least a highest point of the first support is kept in elevation above the second support, the second support is lifted more quickly than the first support, and the substantially horizontal main surface of the second support is kept in its horizontal alignment. This type of apparatus is suitable for accommodating a stack of sheets which has sheets of different thicknesses in its end regions. The thicker end regions can be laid here on the substantially horizontal, flat main surface of the second support by means of which these can lie cleanly on top of one another, and the stack of sheets can be prevented from fanning out in this region. By lifting the second support more quickly it is possible to keep the end regions of the uppermost sheet of the stack of sheets substantially on the same level. The first and second supports are preferably arranged here such that the stack of sheets can sag in the central region. In this way, the central region, where a sheet feeder unit generally engages, can be prevented from being clamped against the latter before sensors detect the correct position of the stack of sheets.

According to a further aspect, a sheet feeder is provided, the sheet feeder having a sheet feed unit and a lifting unit of the type described above disposed below sheet feed unit, the sheet feed unit being disposed such that it conveys a sheet substantially parallel to a separation line between the first and second supports.

According to yet a further aspect, a process for lifting a stack of sheets is provided with which a stack of sheets is initially placed on at least a first support and at least a second support, the first support defining a first contoured or flat support surface, and the second support defining a second support surface which has a substantially horizontal, flat main surface. Next the first and second supports are lifted such that at least the highest point of the first support is kept in elevation above the second support, the second support is lifted more quickly than the first support, and the substantially horizontal, flat main surface of the second support is kept in its horizontal alignment. With this process the advantages already mentioned with regard to the apparatus may be obtained.

According to yet a further aspect, a process is provided for feeding a sheet to a down-stream unit in which a stack of sheets is initially lifted into the vicinity a sheet feed unit by the process described above, and is then fed to the downstream unit by the sheet feed unit. In so doing, the sheet feed unit conveys the sheet to be fed substantially parallel to a separation line between the first and second supports.

BRIEF DESCRIPTION OF DRAWINGS

In the following, the present invention is described in greater detail with reference to the drawings which show different embodiments; the drawings show as follows.

MODES FOR CARRYING OUT THE INVENTION

Any directional or positional details given in the following description relate to the illustration of the drawings and should not be considered to be restrictive. A first embodiment of a sheet feeder is described in greater detail below by means of FIGS. 1 to 5.

Figure 1:
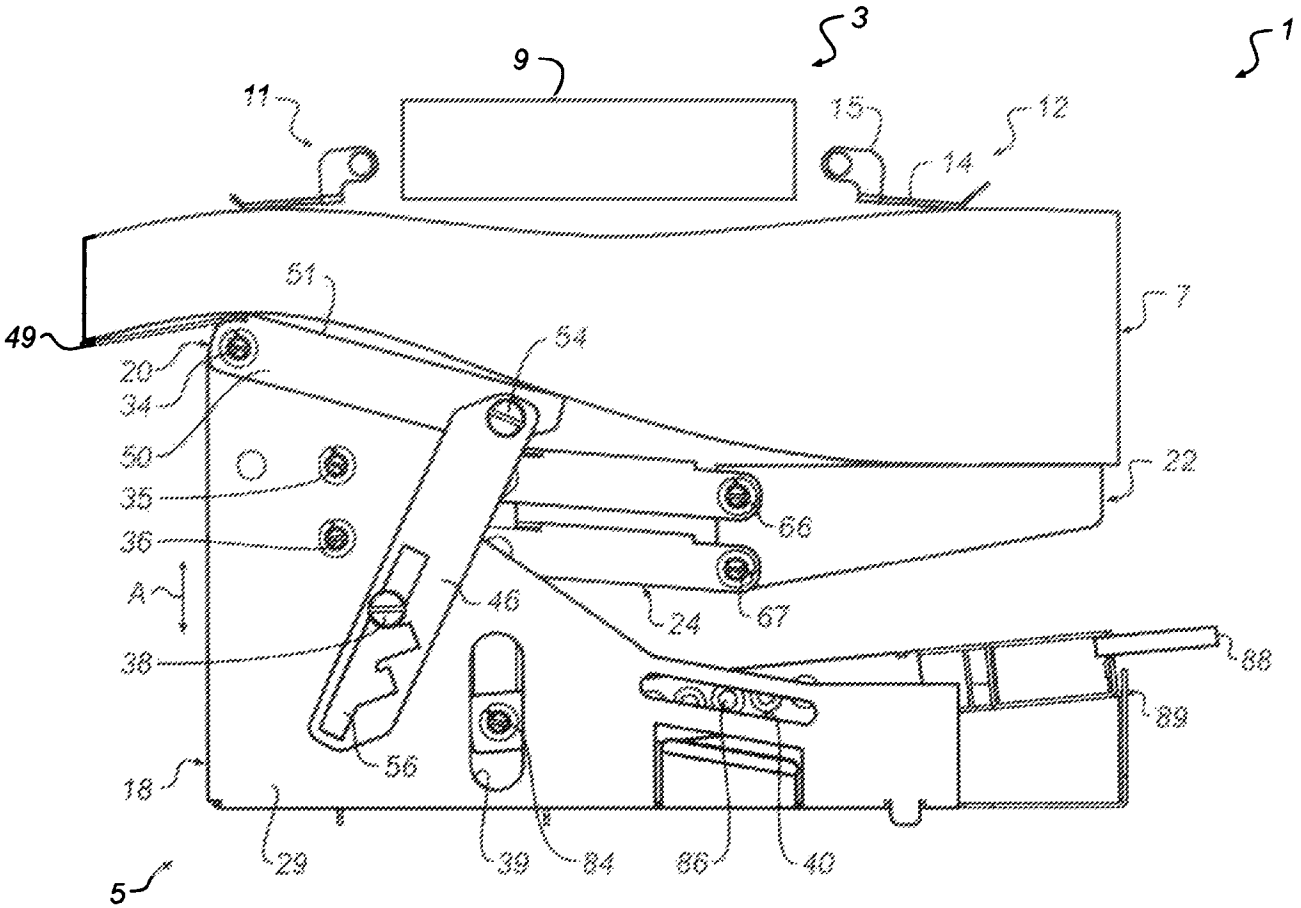
FIG. 1 a schematic side view of a sheet feeder according to the present invention.

FIG. 1 shows a schematic side view of a sheet feeder 1, as suitable for example for feeding sheets into printing machines. As will be explained below, the sheet feeder 1 is especially suitable for sheets which are of different thicknesses in their end regions lateral to the feed direction of the sheet feeder.

The sheet feeder 1 has a sheet feed unit 3 at the top and a lifting unit 5 lying arranged therebelow for accommodating and lifting a stack of sheets 7. The sheet feed unit 3 has a suction belt-type feed mechanism which is suggested schematically by 9. The feed mechanism 9 is disposed such that it lies laterally to its feed direction, approximately centrally above the stack of sheets 7. It is designed such that it can accommodate an uppermost sheet of the stack of sheets 7 and convey the latter perpendicularly to the plane of the page of the figures (i.e. in the plane of the uppermost sheet). This suction belt-type feeding mechanism is generally known in the technology, and so will not be described in greater detail here.

Furthermore, the sheet feed unit 3 has a nozzle arrangement for directing a jet of air onto a front edge, as viewed in the sheet feed direction, of the uppermost sheet of the stack of sheets 7. The jet of air serves to slightly lift the uppermost sheet, by means of which better contact with the feed mechanism 9 and a better release from the stack of sheets 7 is made possible. The nozzles are directed here in particular towards a central region of the front edge of the upper sheet of the stack of sheets 7 and so lie in the region of the feed mechanism 9. This central region of the upper sheet of the stack of sheets 7 sags slightly due to the structure of the lifting unit 5, as will be explained in greater detail below.

Furthermore, the sheet feed unit 3 has sensors 11, 12 which are disposed laterally to the feed direction of the feed mechanism 9 on opposite sides of the latter. The sensors 11, 12 respectively have a sensing device 14 which is attached pivotably within the sheet feed unit by means of a fastener 15. The sensing devices 14 are positioned such that they can come into contact with an upper sheet of the stack of sheets 7, by means of which they are pivoted in order to indicate the height of the stack of sheets 7. The sensing devices contact the upper sheet on opposite sides of the sagging central portion. The sensors 11, 12 are disposed such that the sensing devices 14 contact the uppermost sheet in particular in the region of the highest points of the stack of sheets 7 on the lifting unit 5. This type of sensor is known in the technology, and of course one can also use other sensors which can sense the lift height of the stack of sheets 7 at different points.

The lifting unit 5 has a support frame 18 which is coupled to a lifting unit (not shown), such as for example a stepper motor, so as to be moved up and down, as shown by the double headed arrow A in FIG. 1. The support frame 18 supports a first support 20, a second support 22 and a lifting mechanism 24 for the second support 22, as will be described in greater detail below.

Figure 2:
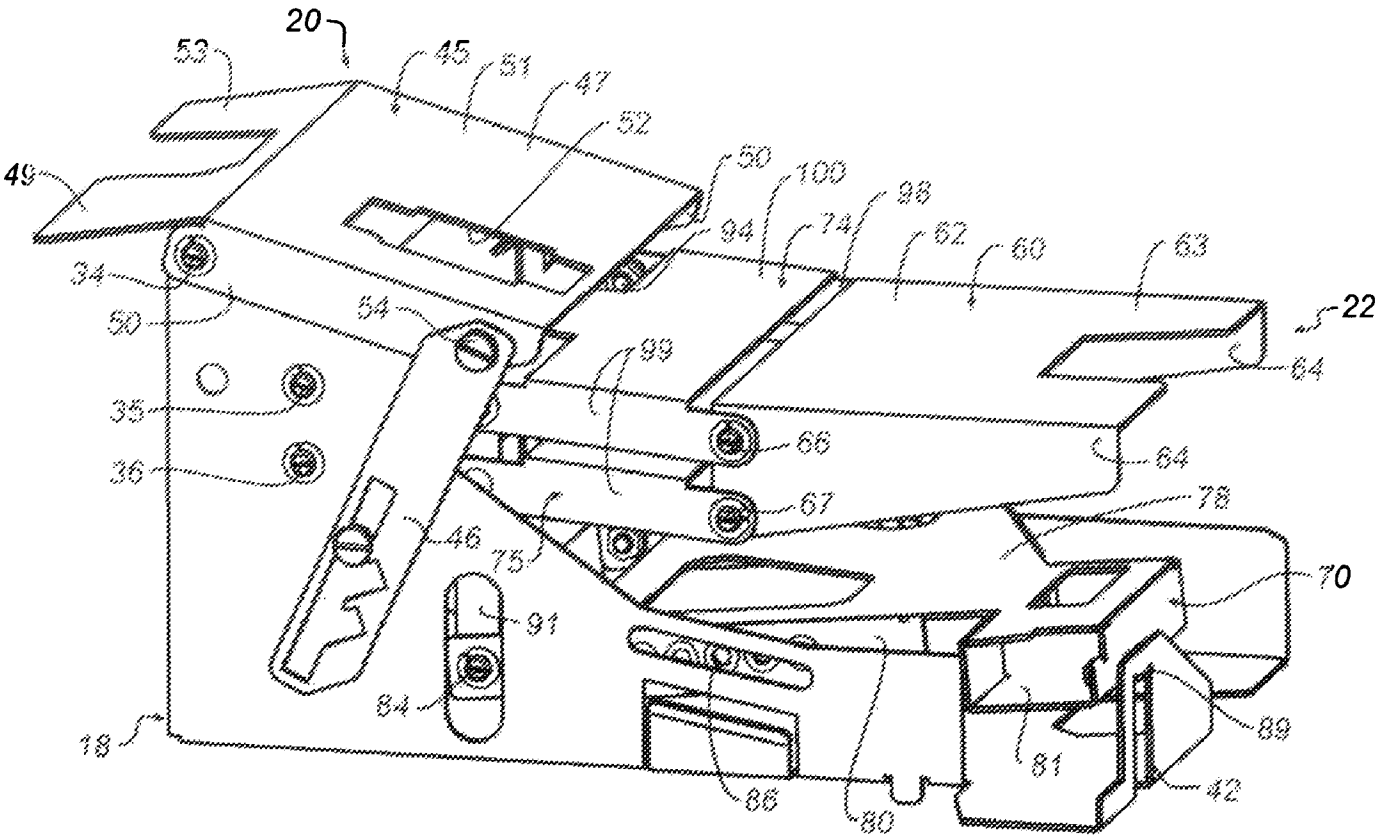
FIG. 2 a perspective view of a lifting unit of the sheet feeder according to FIG. 1 in a first position.
Figure 3:
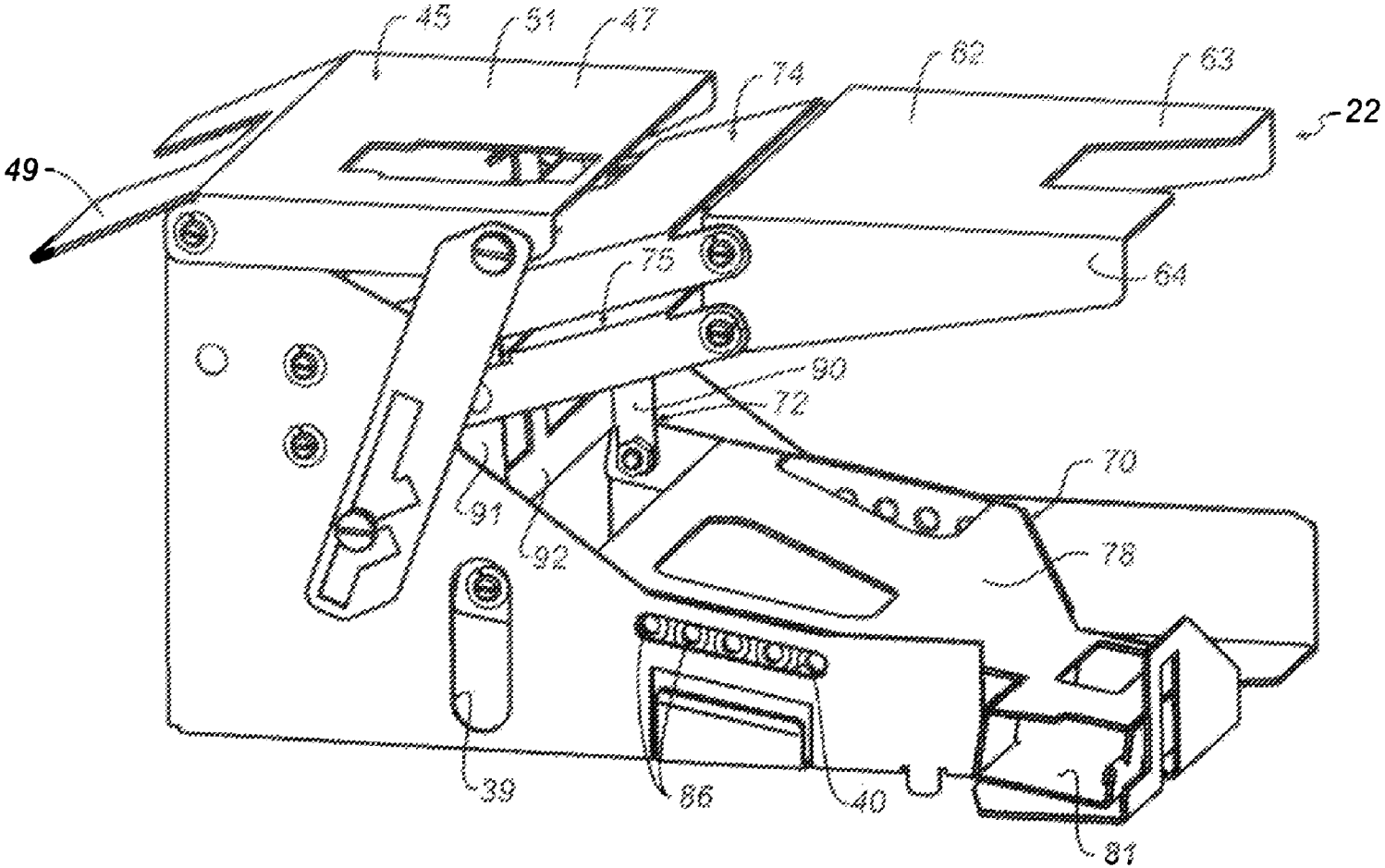
FIG. 3 a perspective view of the lifting unit according to FIG. 2 in another position.
Figure 4:
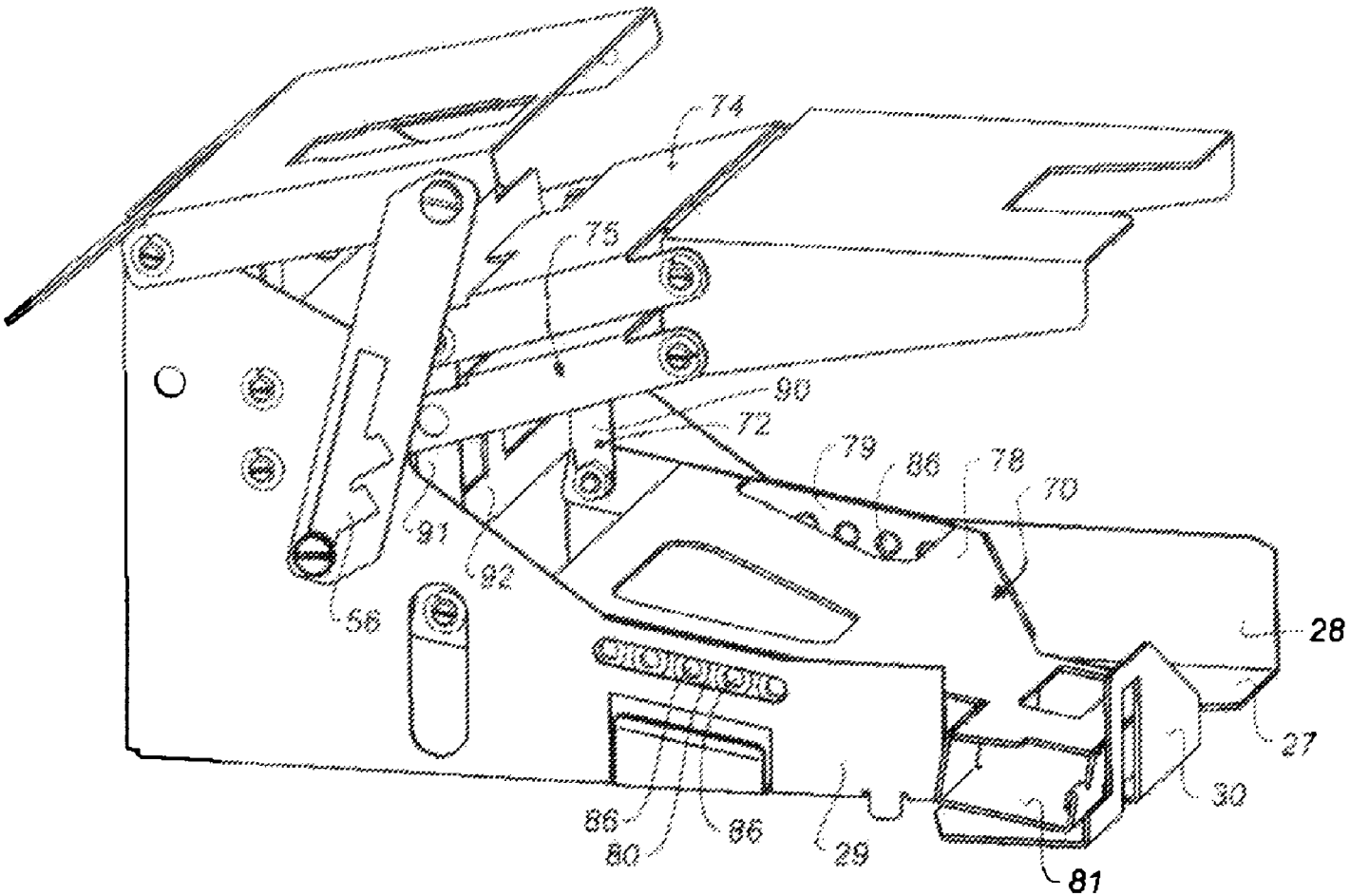
FIG. 4 a perspective view of the lifting unit according to FIG. 2 in a further position.

As can best be seen in the perspective views according to FIGS. 2 to 4, the support frame 18 has a horizontal base plate 27, a rear wall 28 extending perpendicularly to the latter, and a front wall 29 extending perpendicularly to the base plate 27. Furthermore, a side wall portion 30 is shown in the perspective views. A further side wall portion can be provided at the opposite end of the base plate 27 which extends, for example, between the rear wall and the front wall in order to stabilize the latter.

The base plate 27, rear wall 28, front wall 29, side wall portion 30 and the other side wall portion (not shown) can be designed as one part, e.g. made of a punched and bent metal sheet, or they can be made from different components which are fastened appropriately to one another in order to form the support frame 18.

Figure 5:
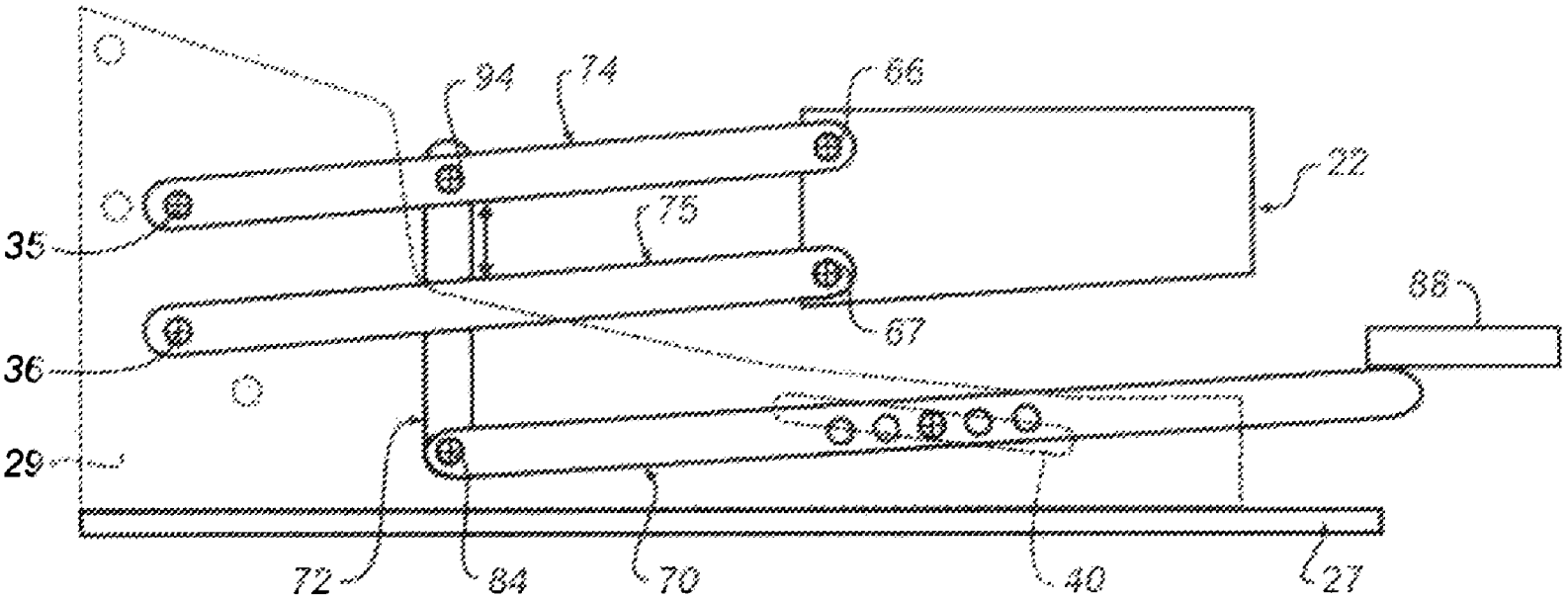
FIG. 5 a simplified schematic illustration of a lifting mechanism of the lifting unit according to FIG. 2.

The rear wall 28 and the front wall 29 are of substantially the same design, and so in the following only the front wall 29 will be described in greater detail. In the side view according to FIG. 1 the front wall 29 is substantially in the shape of a boot with a raised section to the left which passes via inclined sections to a flatter section. This special shape which can best be seen in the dashed illustration in FIG. 5 is not essential, but facilitates access to parts of the lifting unit.

In the upper region of the raised portion the front wall 29 has a first opening for accommodating an axis 34 by means of which, as described in greater detail below, the first support 20 is attached pivotably to the support frame 18. A corresponding opening is also provided in the rear wall 28 so that the first support 20 can be attached pivotably to the rear wall 28 and the front wall 29 by means of respective axes 34. The term axis, as used here and below, describes a connection element for two components which has a shaft portion which is passed through the components to be connected, and allows pivoting of the one component in relation to another. The axes shown respectively have a head portion and the shaft portion which has a thread at least on its free end onto which a nut can be screwed.

Offset at an angle beneath the opening for the axis 34 are two openings disposed perpendicularly over one another for accommodating further axes 35, 36. The axes 35, 36 serve to pivotably attach lifting elements of the lifting mechanism 24 for the second support 22, as described in greater detail below. Corresponding openings and axes are also provided on the rear wall 28.

Furthermore, in the front wall 29 a further opening is provided for accommodating a guide bolt 38 which, as will be described in greater detail below, co-operates with a guide and positioning element of the first support 20.

In the front wall 29 a slot 39 extending in a vertical direction is provided which enables access to parts located behind. Furthermore, the slot serves as a perpendicular guide for a main pivot element of the lifting mechanism, as explained in greater detail below.

Furthermore, a further slot 40 is provided which serves to accommodate an axis (not shown) which co-operates with the lifting mechanism 24. Here the axis can be accommodated in different positions of the slot 40 in order to thus set a transmission ratio of the lifting mechanism 24, as explained in greater detail below.

In the flat region of the front wall 29 the latter is cut away so that it does not extend over the complete width of the base plate 27. It this way it is made possible for part of the lifting mechanism 24 to extend forward of the front wall 29, as can be seen in the perspective illustration according to FIGS. 2 to 4.

A section like this is not provided in the rear wall 28 which can otherwise have substantially the same design, however, as the front wall 29.

In the side wall portion 30 a cut-out 42 is provided which co-operates with a guide lug of the lifting mechanism 24 in order to limit the movement of the lifting mechanism 24, as explained in greater detail below.

In the following the first support 20 of the lifting unit 5 is described in greater detail. The first support 20 has a support element 45 which is formed, for example, by a bent metal sheet, as well as the guide and positioning element 46 already mentioned above. The support element 45 has a main portion 47, an end portion 49 angled with respect to the main portion 47, and side portions 50.

The main portion 47 of the support element 45 has a flat surface 51 with a recess 52 which enables access to parts lying beneath. Furthermore, the recess 52 can be used for a sheet sensor (not shown) in the sheet feed unit 3 which can be optical or mechanical in design. With a mechanical design it would e.g. attempt to contact a sheet from above in the region of the recess 52. If no sheet is present, the sheet sensor would be able to extend through the main portion 47 by means of which the sheet feed unit 3 recognizes that there is no sheet on the support element 45.

The angled end portion 49 directly adjoins the flat main portion 47 at the end of the main portion 47 facing away from the second support 22. The end portion 49 is angled downwards in relation to the plane of the surface 51 and has a flat surface 53.

The side portions 50 of the support element 45 are angled by 90° in relation to the main portion 47 and extend downwards in relation to the plane of the surface 51. The support element 45 is dimensioned such that the side portions 50 partially encompass the rear wall 28 and the front wall 29 of the support frame 18. In the side portions 50 through openings are respectively provided for accommodating the axes 34 described above. These through openings, and so the axis disposed therein, are located substantially directly beneath the transition region between the main portion 47 and the end portion 49. By means of the axes 34 the support element 45 is therefore attached pivotably to the support frame 18.

On an end away from the axis 34 at least one of the side portions has a further opening which serves to accommodate a fastening element, such as for example a bolt 54, by means of which the guide and positioning element 46 is fastened to the support element 45. By means of the bolt 54 the guide and positioning element is attached pivotably in relation to the support element 45.

The guide and positioning element 46 is a flat element, for example a metal sheet, and is substantially in the shape of an elongated rectangle, the edges of this shape being rounded or slanted. In an upper end region of the guide and positioning element 46 an opening is provided through which the bolt 54 can be passed in order to fasten the guide and positioning element 46 pivotably to the support element 45.

Furthermore, the guide and positioning element 46 has a recess 56 in which the guide bolt 38 is partially accommodated. The recess 56 has a substantially rectangular main portion and two side arms extending at an angle to the latter. The main portion of the recess 56 extends from approximately the middle of the guide and positioning element 46 to a lower end region of the latter. The side arms extend at an angle upwardly from the main portion. As can easily be seen, the main portion of the recess 56 provides a guide for pivoting of the support element 45. The side arms of the recess 56 serve to establish a pivot position of the support element 45. The lower side arm of the recess 56 is designed such that it fixes the support element 45 such that the main portion 47 is disposed horizontally. The upper side arm fixes the support element 45 in a pivot position in which the main portion 47 falls in the direction of the second support 22. As can be seen in FIG. 4, the support element 45 can also be pivoted upwardly over the horizontal, by means of which objects or parts of elements are prevented from being squashed between the lifting mechanism 24 and the support element 45. Although the first support 22 illustrated is pivotable, a fixed first support 22 can also be provided. In this case in particular the first support should extend over no more than 40%, and preferably no more than 30% of the width of the stack of sheets (starting from the edge of the latter). In this way it is made possible for the stack of sheets to sag in the central region, as will be explained in greater detail below.

The second support 22 has a support element 60 which is formed, for example, by a bent metal sheet. The support element 60 has a main portion 62 with a surface 63 and side portions 64 angled in relation to the latter. The side portions 64 are bent downwards by 90° in relation to the main portion 62 and have at an end region respectively two passage openings lying vertically one above the other for accommodating axes 66 and 67 in order to provide pivotable fastening to the lifting mechanism 24 for the second support, as will be explained in greater detail below. The surface 63 is substantially flat and is arranged in a horizontal position and is also kept in this alignment during a lifting movement by the lifting mechanism 24. Preferably at least 50% of the surface 63 is flat and substantially in a horizontal position.

In the following the lifting mechanism 24 for the second support is now described in greater detail. The lifting mechanism 24 has a main pivot element 70, a transfer element 72 and two pivot elements 74, 75.

The main pivot element 70 has a main plate 78, side portions 79, 80 and an actuation appendage 81. The side portions 79, 80 and the actuation appendage 81 are fastened appropriately to the main plate 78, or if appropriate designed integrally with each other.

In an end region the side portions 79, 80 respectively have a passage opening for accommodating an axis 84 in order to connect the side portions 79, 80 to the transfer element 72. In this way the main pivot element 70 is fastened pivotably to the transfer element 72. The axis 84 is guided perpendicularly within the slot 39, and this can be implemented by means of a disc (not shown) on the axis 84.

Furthermore, the side portions 79, 80 have a plurality of through openings 86 in a central region. With the embodiment illustrated a total of five through openings 86 in particular are provided in the central region of the side portions 79, 80. These through openings 86 serve to accommodate a pivot axis (not shown) in order to provide a pivot point for the main pivot element 70. Here the pivot axis (not shown) extends through the corresponding slot 40 in the front and rear wall 29, 28 which serves as a pivot support. In the respective side portions 79, 80 the axis is respectively only accommodated in a through opening 86. Dependently upon in which of the through openings 86 the axis is accommodated, the transmission ratio between the opposite ends of the main pivot element 70 changes. Different lifting speeds of the second support 22 can thus be provided dependently upon the sheet characteristics. With the drawings shown according to FIGS. 1 to 3 and 5, the main pivot element 70 is respectively pivoted about the central through opening 86 as if a corresponding pivot axis were accommodated here. Of course a larger or small number of through openings 86 can also be provided in the respective side portions 79, 80 depending on which transmission ratios are to be provided.

The actuation appendage 81 is attached beneath the main plate 78 and extends beyond the front wall 29 from the support frame 18 so as to be able to come into contact with an actuation element 8 which is illustrated diagrammatically in FIGS. 1 and 5. The actuation element 88 is for example a fixed stop which forms part of the sheet feeder 1 or an apparatus interacting with the latter. Contact could be made between the actuation element 88 and the actuation appendage 81 for example by means of a lift movement of the whole support frame 18. On the actuation appendage 81 a lug 89 is provided which is accommodated in the cut-out 42 of the side wall portion 30. The lug is guided to the side within the cut-out 42 and the cut-out 42 also limits a pivot movement of the main pivot element 70.

As described above, the side portions 79, 80 of the main pivot element 70 are connected pivotably to the transfer element 72 at one end. The transfer element 72 has two side portions 90, 91 and a cross beam or strutting 92 extending between the side portions 90, 91. The side portions 90, 91 and the strutting 92 can form one part, e.g. bent from a metal sheet, or comprise a number of components connected appropriately to one another. On their lower end the side portions 90, 91 respectively have an opening for accommodating the axis 84. On their upper end the side portions 90, 91 respectively have a through opening for accommodating an axis 94 in order to connect the transfer element 72 pivotably to the upper pivot element 74 of the lifting mechanism 24. As the person skilled in the art can see, the transfer element could also be connected in the same way to the lower pivot element 75 or to both pivot elements.

One should note e.g. in FIG. 2 the projection which can be seen through the opening 52 beneath support 20. The projection forms part of the transfer element 72 and lifts support 20 if it is not stopped by the positioning element 46.

The pivot elements 74, 75 are of the same design and respectively comprise side portions 98, 99 and strutting 100 which connects the side portions 98, 99. The pivot elements 74, 75 can form one part, e.g. be bent from a metal sheet, or comprise a number of components connected to one another appropriately. In their end regions the side portions 98, 99 respectively have openings for accommodating the axes 35, 36 and 66, 67. In the central region a through opening is provided for accommodating the axis 94. By means of the arrangement of the axes the pivot elements 74, 75 are pivoted in parallel. The support 22 pivotably connected to the pivot elements 74, 75 is moved up and down during pivoting of the pivot elements, whereas the horizontal alignment of the surface 63 is maintained.

In the following the operation of the sheet feeder 1 according to the first embodiment is now described in greater detail. The support frame 18 is lowered via the lifting unit connected to the latter in order to enable a stack of sheets 7 to be supported. The first support 20 is pivoted into a desired position and can be locked in this position. The second support 22 is located in a bottom position lowered in relation to the first support, the free end of the main pivot element 70 being pivoted upwards. As mentioned above, the sheets in a first end region laterally to the feed direction of the sheet feeder 1 have a greater thickness than in the opposite end region. The end region with the greater thickness is placed on the second support 22, whereas the end region with the smaller thickness is placed on the first support 20. In this way a configuration as indicated in FIG. 1 is given. By means of the special configuration of the first and second supports and their positioning in relation to one another, the uppermost sheet of the stack of sheets 7 does not have a flat surface, but in the middle region has a depression, i.e. it sags slightly. This type of sagging can also be seen in the left end region, i.e. the thinner end region, and is caused by the bent end portion 49 of the support element 45. In this position the support frame 18 is now lifted until the sensors 11, 12 detect a desired feed height of the uppermost sheet of the stack of sheets 7.

One can observe here the advantageous positioning of the axis 34 which is located substantially perpendicularly beneath the sensor 11 so that the sensor 11 detects the stack of sheets at the highest point. In this way the uppermost sheet is also prevented to from being pressed against the sheet feed apparatus 3 in the region of the sheet end behind sensor 11. This could cause the uppermost sheet to be clamped against the sheet feed unit 3 so that it is not pulled away from the stack of sheets 7 by the sheet feed unit 3. It is even possible for the forces occurring upon clamping to actuate a safety switch of the sheet feed unit, and for the sheet feeder 1 and, if applicable, the downstream apparatus to be shut down. The sensor 12 also senses the stack of sheets in the highest region, i.e. precisely where the paper is thickest, e.g. due to applied card.

The lifting of the support frame 18 is stopped and the feed mechanism 9 is activated in order to lift the uppermost sheet from the stack 7 and to convey it laterally to the plane of the page according to FIG. 1 away from the stack of sheets 7. As described above, the sheet is previously lifted by blowing air onto a front edge of the stack of sheets and in this way is brought into contact with the feed mechanism 9.

Due to the fact that the stack of sheets sags in the central region, it is ensured that with a lifting movement of the support frame 18 the uppermost sheet is not clamped between the lifting unit 5 and the feed mechanism 9 before the sensors 11, 12 detect the desired lifting height. This situation could occur if the stack of sheets is higher in the central region than in the region in which the sensing devices of the sensors 11, 12 contact the stack of sheets. Due to the fact that the stack of sheets sags however, this situation can be prevented. Even if the uppermost sheet is substantially flat due to its own rigidity, clamping against the feed mechanism 9 could be prevented because a certain resiliency in the central region can be provided by the design of the first and second supports 20, 22.

When the uppermost sheet of the stack of sheets 7 is conveyed away, the support frame is lifted further until the uppermost sheet is once again located in the feed position. With this lifting movement the free end of the main pivot element 70 comes into contact with the fixed actuation element 88, by means of which pivoting of the main pivot element is caused. By means of this pivoting the second support 22 is now lifted more quickly than the first support with the overall lifting movement of the support frame 18. By selecting the appropriate through opening 86 of the main pivot element 70 for the pivot axis here, the lift ratio between the first and second support 20, 21 is adapted, such that the uppermost sheet actuates the sensing devices of the sensors 11, 12 respectively at substantially the same time.

This process is continued until the final sheet is conveyed away from the stack of sheets. At this moment the second support 22 is located at substantially the same height as the highest point of the first support 20. While lifting the stack of sheets 7 in the above way it is possible to pivot the first support 20 in order to move the flat surface 51 with a decreasing stack of sheets towards the horizontal. This could be achieved e.g. by means of a tension spring between the end portion 49 of the support element 45 and the support frame. Of course other apparatuses can also be provided for this movement, such as e.g. the projection on the transfer element 72.

The lifting unit 5 can also be used for sheets with constant thicknesses, in this case for example the first support 30 being locked such that the surface 51 of the main portion 47 of the support element 45 is horizontal. At the same time the second support 22 would be pivoted to a height corresponding to the first support 20, and locked at this height by appropriate means. This type of situation can for seen, for example, in FIG. 3. The first and second supports 20, 21 then form a substantially flat total support. By lifting and lowering the support frame 18 a substantially flat stack of sheets can then be lifted and lowered. The illustration according to FIG. 3 can however also show the arrangement of the sheet feeder 1 when the final sheet has been pulled away so that both supports 20 and 22 are substantially horizontal and at the same height.

Figure 6:
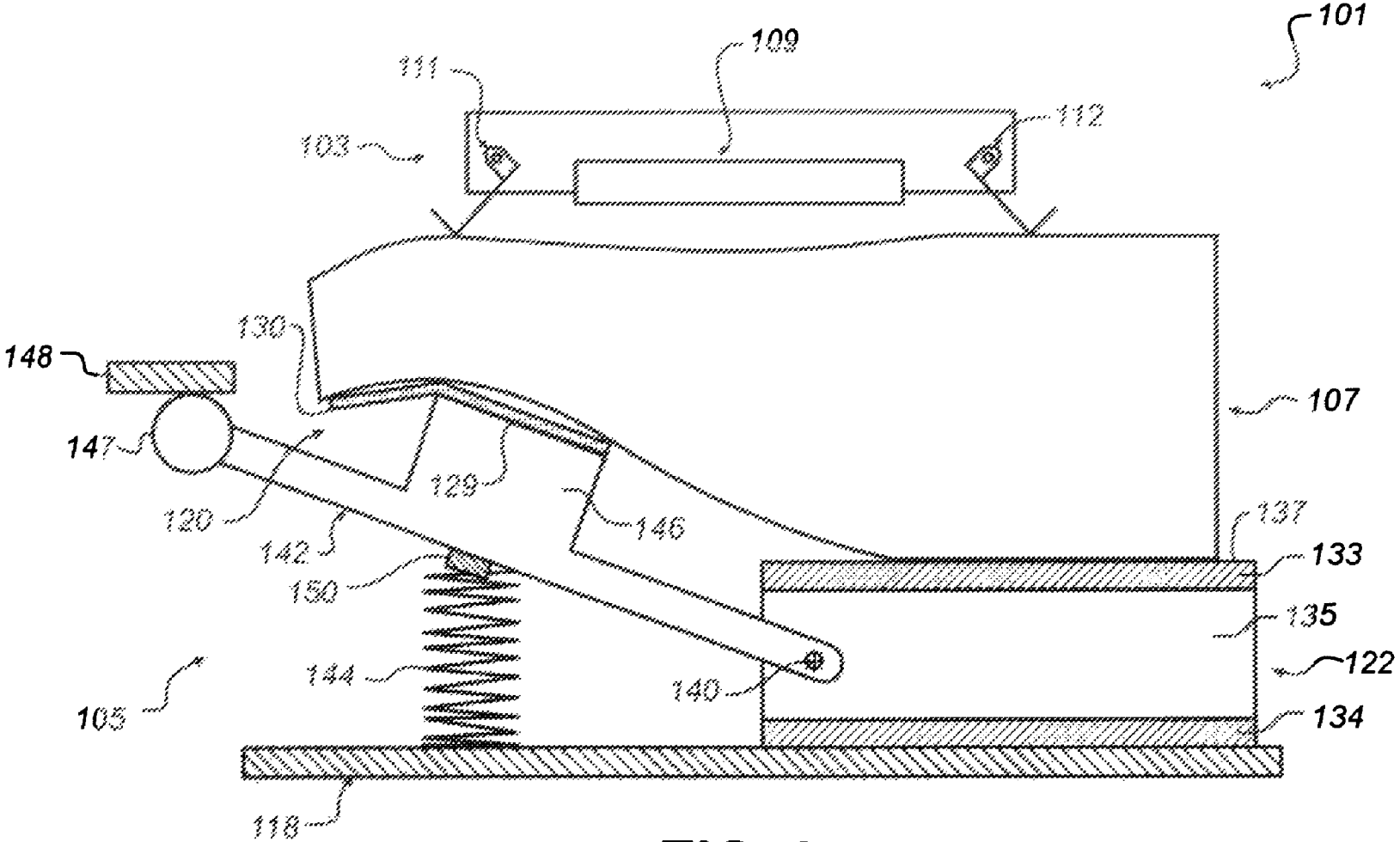
FIG. 6 a schematic sectional illustration of an alternative sheet feeder according to the present invention.

FIG. 6 shows an alternative embodiment of a sheet feeder 101 according to the present invention. The sheet feeder 101 has a sheet feed unit 103 and a lifting unit 105 for accommodating a stack of sheets 107. The sheet feed unit 103 can be of substantially the same design as with the previous embodiment. In particular, a suction belt-type feed mechanism 109 and sensors 111, 112 are provided.

However, the lifting unit 105 differs from the lifting unit 5 according to the first embodiment. The lifting unit 105 once again has a support frame 118, a first support 120, a second support 122 and a lifting mechanism 124 which in this embodiment, however, is provided for the first support 120 instead of for the second support 122.

The support frame 118 is connected to a lifting apparatus (not shown) such as for example a stepper motor or some other sort. Only a base plate 27 of the support frame 118 is shown, but, as with the previous embodiment, the frame can also have a rear wall, a front wall and side wall portions.

The first support 120 comprises a support element 127 with a main portion 129 and an end portion 130 at an angle to the latter. The main portion 129 and the end portion 130 respectively have a substantially flat surface, and the end portion 130 is angled downwardly in relation to the flat surface of the main portion 129. The end portion 130 is formed at the end of the support element 127 away from the second support 122. A lower side of the main portion 129 is supported by the lifting mechanism 124 for the first support, as explained in greater detail below.

The second support 122 is made up of a support element 132 which is formed, for example by a rectangular element. The support element 132 here has an upper portion 133, a lower portion 134 and side portions 135. The upper portion 133 forms a flat support surface 137 for the stack of sheets 107 which is disposed substantially horizontally. The lower portion 134 lies on a base plate of the support frame 118 and can be fastened to the latter in an appropriate manner. The side portions 135 respectively have a through opening for accommodating an axis 140 in order to attach the lifting mechanism 124 pivotably to the second support 122. Alternatively, it is also possible to attach the lifting mechanism 124 pivotably to side portions of the support frame 118.

The lifting mechanism 124 for the first support 120 essentially comprises a pivot lever 142 which is fastened pivotably to the second support by means of the axis 140 and a compression spring 144 which biases the pivot lever 142 upwardly. In a central region the pivot lever 142 has an elevation 146 to which the first support 120 is attached. At the free end of the pivot lever 142 an actuation element 147 is provided which can be brought into contact with a fixed actuation element 148 in order to pivot the pivot lever downwardly against the bias of the compression spring 144. Beneath the pivot lever 142 a guide appendage 150 is provided in order to guide the compression spring 144 and to keep it in contact with the pivot lever 142.

The compression spring 144 extends between the support frame 118 and a lower side of the pivot lever 142.

In the following the operation of the sheet feeder 101 is now described in greater detail with reference to FIG. 6.

First of all the support frame 118 is lowered, by means of which the pivot lever 142 and so the first support 120 is moved upwardly by the compression spring 144 over the plane of the second support 122.

Next a stack of sheets 107 is placed on the lifting unit 105. Once again, the sheets of the stack of sheets 107 here have a first end region laterally to the feed direction of the feed mechanism 109 which is thicker than an opposite end region, as shown schematically in FIG. 6. The thicker region is placed on the second support 122, whereas the thinner region lies on the first support 120. Due to the design of the first and second supports 120, 122, the uppermost sheet once again sags in the central region and in the region of the sensors 111, 112 respectively has its greatest height.

The support frame 118 is now lifted until the sensors 111, 112 detect a feed height of the uppermost sheet of the stack of sheets 107. Next the uppermost sheet is conveyed away in the same way as described in the first embodiment. Next the support frame is lifted further once again until the next sheet of the stack of sheets 107 is at a pre-determined feed height. The actuation element 147 on the lifting mechanism 124 contacts the fixed actuation element 148, by means of which the pivot lever 142 is lowered against the biasing of the compression spring 144. By means of this lowering the first support is lifted less quickly than the second support. In this way it is possible for the sensors 111, 112 always to be operated substantially evenly and the uppermost sheet to be at substantially the same height in the regions of the sensors 111, 112.

This operation is continued until the highest point of the first support lies on substantially the same plane as the surface 137 of the second support 122, and the final sheet of the stack of sheets 107 is conveyed away.

The sheet feeder 101 is once again also suitable for sheets of a thickness which remains the same. In order to feed sheets of a thickness which remains the same, the first support is pivoted into a position in which the main portion 129 of the first support is located at substantially the same height as the upper side 137 of the second support 122. In this position the pivot lever 142 is locked by appropriate means so that the first and second supports 120, 122 substantially form one plane. By lifting the support frame 118 a stack of sheets consisting of sheets of a constant thickness can now be lifted into the region of the sheet feed unit 103.

Figure 7:
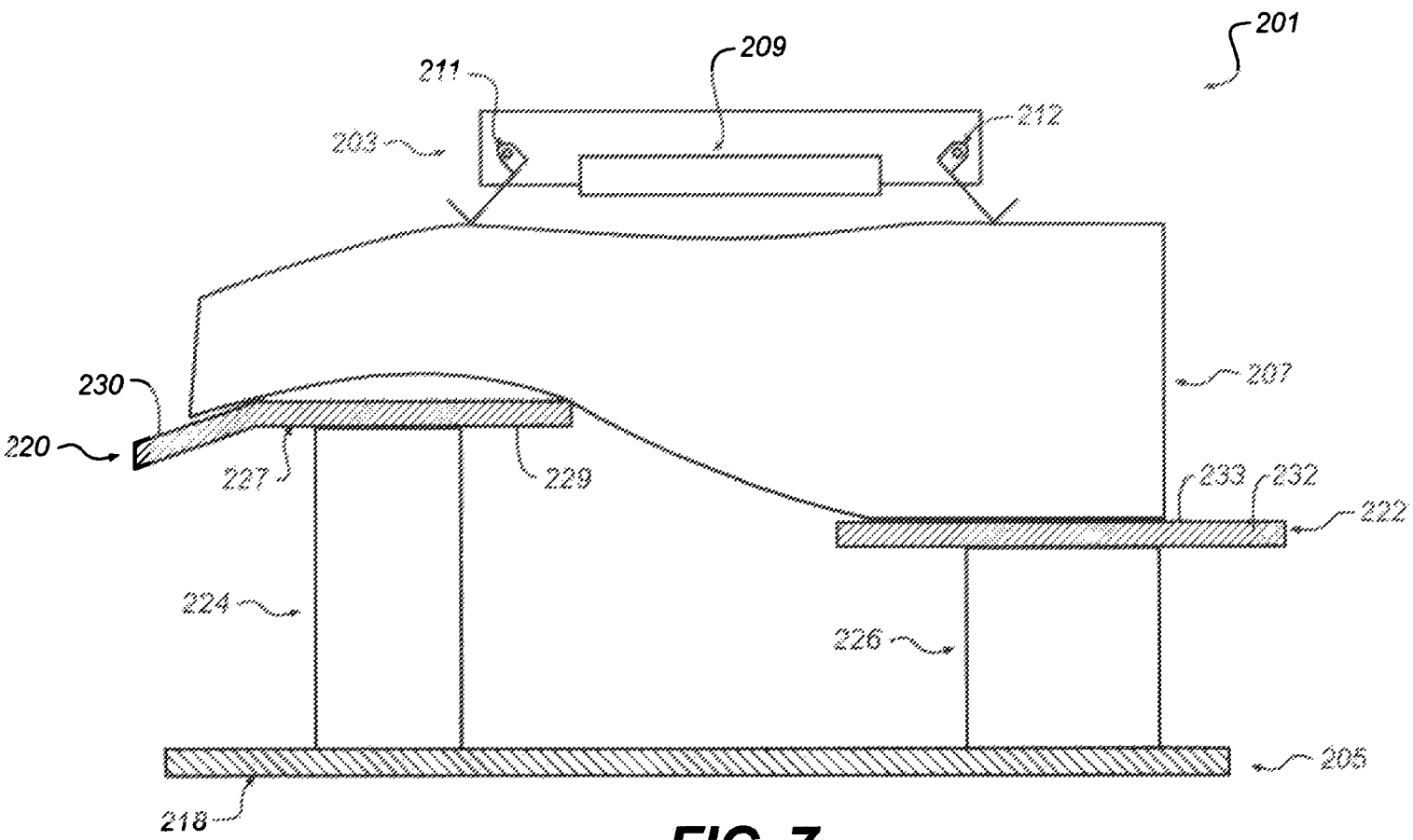
FIG. 7 a schematic sectional illustration of a sheet feeder according to a further embodiment of the present invention.

FIG. 7 shows a further alternative embodiment of a sheet feeder 201. The sheet feeder 201 has a sheet feed unit 203 and a lifting unit 205 for accommodating a stack of sheets 207. The sheet feed unit 203 is of substantially the same design as the sheet feed unit 103 according to FIG. 6. In particular, a suction belt-type feed mechanism 209 and sensors 211, 212 are provided.

The lifting unit 205 differs from the previously described lifting units 5 and 105, respectively. The lifting unit 205 has a support frame 218, a first support 220, a second support 222 and separate lifting mechanisms 124 and 126 for the first and second supports. As with the previous embodiments, the support frame 218 can be connected to a lifting apparatus in order to move the support frame 218 up and down. Alternatively however, it is also possible to design the support frame 218 to be stationary so as to bring about upwards and downwards movement of the stack of sheets 207 exclusively by means of the lifting mechanisms 224 and 226, respectively.

The first support 220 comprises a support element 227 with a main portion 229 and an end portion 230 which is angled with respect to the main portion 229. The main portion 229 and the end portion 230, respectively, have a substantially flat surface. In relation to the flat surface of the main portion 229 the end portion 230 is angled downwards. In relation to the second support 222 the end portion 230 is formed at the far end of the support element 227. A lower side of the main portion 229 of the support element 227 is supported by the lifting mechanism 224, as will be explained in greater detail below.

The second support 222 comprises a support element 232 which is formed, for example, by a flat plate. The support element 232 is supported on its lower side by the lifting mechanism 226 and has a flat surface 233.

The support elements 227 and 232 of the first and second supports 220, 222, respectively, are spaced apart such that a stack of sheets placed on the latter can sag slightly into the space between the support elements 227, 232. Even though this is not shown in the figures, it can also be possible to attach the first support element 227 pivotably to the lifting mechanism 224 in order to make it possible to position the main portion 229 of the support element 227 at an angle to the support element 232.

The lifting mechanisms 224, 226 are of any appropriate type which is suitable for lifting the respective support 220 and 222, respectively and a stack of sheets 207 placed thereon. The lifting mechanisms 224, 226 here are designed such that the lifting mechanism 226 lifts the second support 222 more quickly than the lifting mechanism 224 lifts the first support 220. This can be achieved, for example, by means of respective compression springs with a different spring force. However, respective individually controllable drive units, such as for example a respective stepper motor, can be provided which lifts the respective supports. Therefore, it is also possible, for example, for a common drive element, such as for example a stepper motor, to be provided which drives a shaft which engages, for example, by means of different sizes of gears or cog wheels with respective racks of the lifting mechanisms 224, 226 in order to lift the latter simultaneously, but with different speeds. By means of the selection, and if appropriate change of the gears, the sheet-dependent lift ratios can be set. The person skilled in the art is offered various design possibilities for the respective lifting mechanism. When moving the respective supports one should ensure that the alignment of the second support is essentially maintained during the lift movement and that the latter is lifted more quickly than the first support 220.

In the following the operation of the sheet feeder 201 is now explained in greater detail with reference to FIG. 7.

Initially the first and second supports 220, 222 are lowered, and this can be implemented on the one hand by lowering the support frame and on the other hand by means of the lifting mechanisms 224 and 226. Next a stack of sheets 207 is placed on the supports 220, 222. The sheets of the stack of sheets 207 once again have a first end region laterally to the feed direction of the feed mechanism 209 which is thicker than an opposite end region, as shown schematically in FIG. 7. The thicker region is placed on the second support 222, whereas the thinner region lies on the first support 220. Due to the distance between the supports, or also due to angled positioning of the first support 220, the uppermost sheet sags in the central region and has its greatest height in the region of the sensors 211, 212 respectively.

The first and second supports 220, 222 are now lifted, the second support 222 being lifted more quickly than the first support 220, until the sensors 211, 212 detect a pre-determined feed height of the uppermost sheet of the stack of sheets 207. Now the uppermost sheet is conveyed away from the stack of sheets 207 in the manner described above.

Next the first and second supports 220, 222 are once again lifted until the next sheet is at the pre-determined feed height. As already described above, the second support 222 is lifted more quickly than the first support 220.

This process is continued until the final sheet of the stack of sheets 207 is conveyed away.

The sheet feeder 201 can once again also be used for sheets with a thickness which remains the same. For this purpose the lifting mechanisms 224, 226 are adapted such that they provide an equal lifting speed, and before positioning the stack of sheets 207 the first and second supports are set to substantially the same height.

In the same way as with the previously described exemplary embodiments the sec- and support 222 can be lifted more quickly during operation than the first support 220, and the second support has a substantially horizontal surface. In this way one prevents the thicker region of the stack of sheets from fanning out. Although a horizontal alignment is preferred, the surface of the second support must not be kept exactly horizontal. In fact, a slightly inclined position of for example 5 to 10° to the horizontal is conceivable. Preferably the deviation from the horizontal should be less than 5°. This angular range should be embraced by the wording substantially horizontal.

Similarly to the first support, the second support can also have an end region at an angle to the latter which is provided on the end away from the first support. An angled end region could also be provided on the end region of the second support facing towards the first support in order to facilitate slight sagging of the stack of sheets 207 in the central region. Of course the first support could also have a downwardly angled end region which faces towards the second support.

Figure 8:
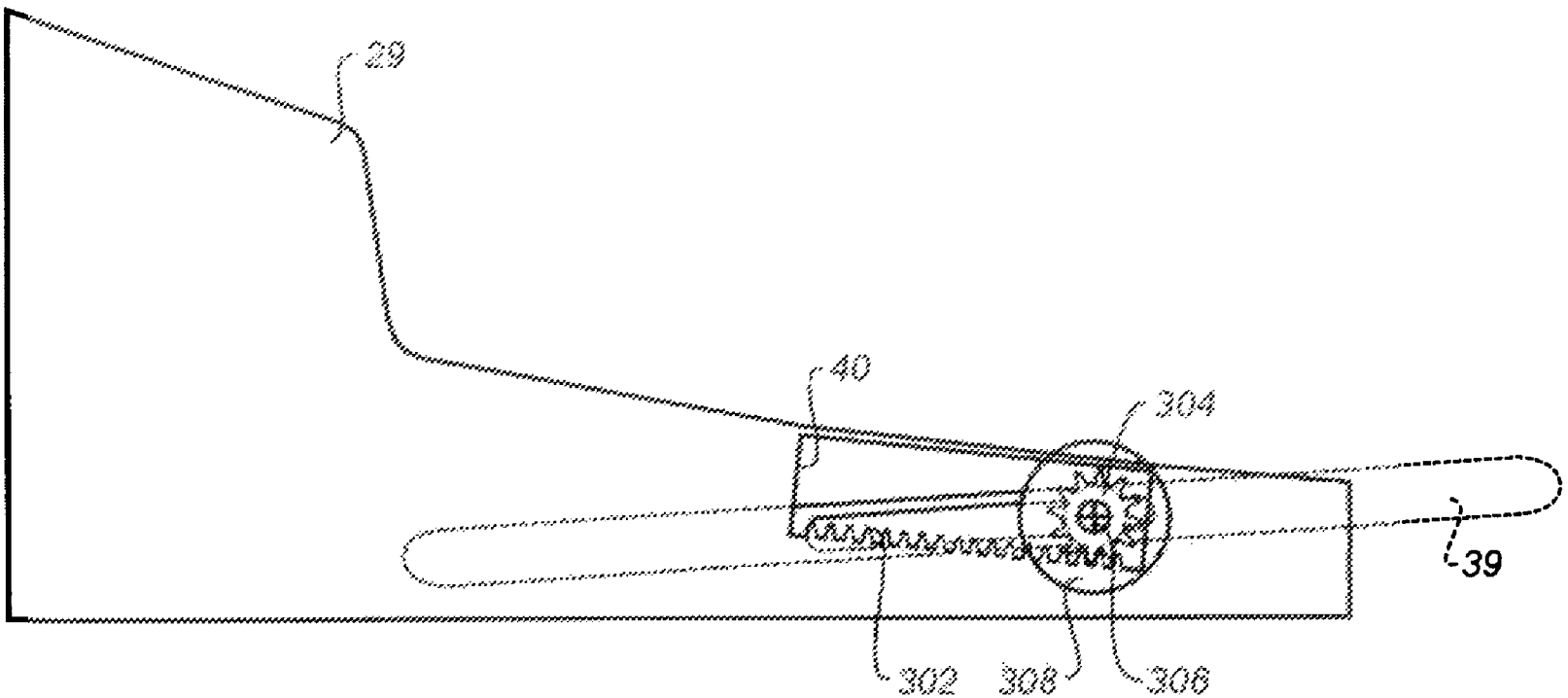
FIG. 8 a schematic side view of an alternative mechanism for setting the pivot point for a lifting mechanism according to FIG. 5.

FIG. 8 shows a detail view of an alternative adjustment apparatus for the pivot point of the main pivot element 70 according to the embodiment of FIGS. 1 to 5. In FIG. 8 the same reference sign are used as with the embodiment according to FIGS. 1 to 5 in so far as the same or identical elements are being identified.

As can be seen in FIG. 8, instead of the plurality of passage openings 86 in the side portions 79, a slot 300 can also be provided in the side portions 79 of the main pivot element 70. The slot 40 in the front and/or rear wall 29, 28 can have a series of teeth 302 which interact with a gear or cog wheel 304 which is connected in a rotationally fixed manner to an axis 306 which forms the pivot point for the main pivot element. The cog wheel 304 is in turn connected to a handle 308 by means of which the position of the axis 306 can be set. As will be recognized by the person skilled in the art, by turning the handle 308 the position of the axis 306 within the slot 300 in the side portions 79 of the main pivot element (and so the pivot point) can be varied substantially infinitely. In this way substantially infinite sheet-specific lift ratios between the first and second supports can be set.

In the previously described first two embodiments of the invention a fixed actuation element 88 or 148 is respectively provided in order to control a lift movement of the first and second supports. For reasons relating to safety the respective actuation element can however be designed to be moveable above a pre-determined threshold value in order to prevent damaging clamping of objects or parts of elements between different pivotable parts of the lifting units. This can be achieved, for example, in that the respective actuation element is bias into the actuation position by means of a biasing element, such as a spring, but can be moved against the bias if a threshold value is exceeded.

The invention has been described above with reference to preferred embodiments of the invention, without being restricted to the specific embodiments. Some features of the individual embodiments can, if compatible, be combined and/or exchanged with features of other embodiments. The person skilled in the art can make different modifications which come within the scope of the following claims.

The invention claimed is:

1. A lifting unit for lifting a stack of sheets, said unit comprising: at least a first support and at least a second support, the first support defining a first contoured or flat support surface, and the second support defining a second support surface which has a substantially horizontal, flat main surface, and;

at least one unit for lifting the first and second supports such that at least a highest point of the first support is kept elevationally above the second support, the second support is lifted more quickly than the first support, and the substantially horizontal, flat main surface of the second support is kept in its horizontal alignment.

2. The lifting unit according to claim 1, wherein at least 50% of the second support surface is formed by the substantially horizontal, flat main surface.

3. The lifting unit according to claim 1, wherein the first and second supports are disposed such that the stack of sheets can sag in the central region.

4. The lifting unit according to claim 1, wherein the first support extends over no more than 40%, and preferably no more than 30% of the width of the stack of sheets.

5. The lifting unit according to claim 1, wherein the first support is mounted pivotably about a pivot point.

6. The lifting unit according to claim 1, wherein the first support surface has a substantially flat main portion.

7. The lifting unit according to claim 6, wherein the angle of the substantially flat main portion can be set in relation to the horizontal such that the main portion descends towards the second support surface.

8. The lifting unit according to claim 6 wherein the first support surface has a downwardly angled end portion at its end facing away from the second support.

9. The lifting unit according to claim 5 wherein the first support surface has a downwardly angled end portion, the pivot point is disposed in the region of the transition between the main portion and the end portion.

10. The lifting unit according to claim 1, wherein the first and second supports are fastened to a common support frame.

11. The lifting unit according to claim 10, wherein the support frame is coupled to a lifting unit in order to lift or lower the support frame.

12. The lifting unit according to claim 1, wherein the first and/or second support is/are fastened moveably to the common support frame.

13. The lifting unit according to claim 12, wherein the first and/or second support is fastened to the common support frame by means of a pivot mechanism.

14. The lifting unit according to claim 13, wherein the second support is fastened to the common support frame by means of a pivot mechanism, and the pivot mechanism has a four bar linkage in order to maintain the horizontal alignment of the second support during a lifting movement.

15. The lifting unit according to claim 13, wherein the pivot mechanism can be actuated by a lifting movement of the common support frame.

16. The lifting unit according to claim 15, wherein the pivot mechanism has at least one lever element with an actuation end which co-operates with a substantially stationary actuation element.

17. The lifting unit according to claim 16, the substantially stationary actuation element is moveable above a threshold value of a force applied to the latter.

18. The lifting unit according to claim 16, wherein the lever element has a lifting end opposite the actuation end which is coupled to the first and/or second support, and wherein the lever element being pivotably mounted about a pivot axis between the two ends.

19. The lifting unit according to claim 18, wherein the position of the pivot axis between the two ends can be adjusted.

20. The lifting unit according to claim 16, wherein the lever element is pivotably mounted on an end opposite the actuation end.

21. The lifting unit according to claim 20, wherein the lever element is coupled to the first support and is biased upwardly by a biasing element.

22. The lifting unit according to claim 1, wherein separate units are provided for differential lifting of the first and second supports.

23. The lifting unit according to claim 22, wherein the separate units are coupled to a common drive.

24. The lifting unit according to claim 1, wherein the first and second supports are disposed such that a stack of sheets lying thereon sags in the central region.

25. A sheet feeder having a sheet feed unit and a lifting unit according to claim 1 disposed beneath the sheet feed unit, the sheet feed unit being disposed such that it conveys a sheet substantially parallel to a separation line between the first and second supports.

26. The sheet feeder according to claim 25, wherein the sheet feed unit has at least one sensor which senses the position of an uppermost sheet of a stack of sheets located on the lifting unit in order to control a movement of the lifting unit.

27. The sheet feeder according to claim 26, wherein at least two sensors are provided, at least one sensor being provided above the first support, and at least one sensor being provided above the second support.

28. The sheet feeder according to claim 1, wherein the sheet feed unit has a suction belt-type feed mechanism.

29. The sheet feeder according to claim 28, wherein the feed mechanism is disposed above a central region of the stack of sheets.

30. A process for lifting a stack of sheets in which a stack of sheets is initially placed on at least a first support and at least a second support, the first support defining a first, contoured or flat support surface, and the second support defining a second support surface which has a substantially horizontal, flat main surface, comprising the following steps: lifting the first and second supports such that at least the highest point of the first support is kept elevationally above the second support, the second support is lifted more quickly than the first support, and the substantially horizontal, flat main surface of the second support is kept in its horizontal alignment.

31. The process according to claim 30, wherein at least 50% of the second support surface supports the stack of sheets substantially horizontally.

32. The process according to claim 30, wherein the first and second supports are disposed such that the stack of sheets sags in the central region.

33. The process according to claim 30, wherein the first support extends over no more than 40%, and preferably no more than 30% of the width of the stack of sheets.

34. The process according to claim 30 wherein the first support is pivoted in relation to the horizontal alignment of the second support.

35. The process according to claim 30, wherein the first support surface has a substantially flat main portion which descends towards the second support.

36. The process according to claim 30, wherein the first support surface has a downwardly angled end portion at its end facing away from the second support.

37. The process according to claim 30, wherein the first and second supports are lifted by means of a common support frame.

38. The process according to claim 30, wherein the first and/or second support is moved by a lifting mechanism with a different speed to the other support.

39. The process according to claim 38, wherein the first and/or second support is moved by means of a pivot mechanism with a different speed to the other support.

40. The process according to claim 39, wherein the pivot mechanism is actuated by means of a lifting movement of the common support frame.

41. The process according to claim 40, wherein the pivot mechanism has at least one lever element with an actuation end which co-operates with a substantially stationary actuation element.

42. The process according to claim 41, wherein the substantially stationary actuation element is moved above a threshold value of a force applied to the latter.

43. The process according to claim 41 or 42, characterized in that a transmission ratio of the pivot mechanism is set dependently upon the sheets forming the stack of sheets.

44. The process according to any of claims 30 to 43, characterized in that the first and second supports are lifted by means of separate units.

45. The process according to claim 44, characterized in that the separate units are coupled to a common drive.

46. The process according to any of claims 30 to 45, characterized in that the first and second supports are disposed such that a stack of sheets placed thereon sags in the central region.

47. A process for feeding a sheet to a downstream unit, characterized in that a stack of sheets is lifted to the region of a sheet feed unit by means of a process according to any of claims 30 to 46, and is then fed by the sheet feed unit to the downstream unit, the sheet feed unit conveying the sheet substantially parallel to a separation line between the first and second supports.

48. The process for feeding a sheet according to claim 47, characterized in that the position of an uppermost sheet of the stack of sheets is sensed in order to control a movement of the stack of sheets.

49. The process for feeding a sheet according to claim 47 or 48, characterized in that in its central region the uppermost sheet of the stack of sheets is brought into contact with the sheet feed unit so as to feed said sheet.

50. The process for feeding a sheet according to claim 49, wherein the position of the uppermost sheet is sensed on both sides of the sheet feed unit.

* * * * *